US007875133B2

(12) United States Patent
Pandey

(10) Patent No.: US 7,875,133 B2
(45) **Date of Patent: *Jan. 25, 2011**

(54) HEAT TREATABLE $L1_2$ ALUMINUM ALLOYS

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 61 days.

This patent is subject to a terminal disclaimer.

(21) Appl. No.: 12/148,396

(22) Filed: Apr. 18, 2008

(65) Prior Publication Data

US 2009/0260725 A1 Oct. 22, 2009

(51) Int. Cl.

| | |
|---|---|
| ***C22C 21/16*** | (2006.01) |
| *C22C 21/06* | (2006.01) |
| *C22F 1/04* | (2006.01) |

(52) U.S. Cl. ..... 148/439; 148/417; 148/418; 148/549; 148/550; 148/552

(58) Field of Classification Search ..... 148/439, 148/550, 417, 418, 440, 549, 552, 690, 693
See application file for complete search history.

(56) References Cited

U.S. PATENT DOCUMENTS

| | | | |
|---|---|---|---|
| 3,619,181 | A | 11/1971 | Willey et al. |
| 3,816,080 | A | 6/1974 | Bomford et al. |
| 4,041,123 | A | 8/1977 | Lange et al. |
| 4,259,112 | A | 3/1981 | Dolowy, Jr. et al. |
| 4,463,058 | A | 7/1984 | Hood et al. |
| 4,469,537 | A | 9/1984 | Ashton et al. |
| 4,499,048 | A | 2/1985 | Hanejko |
| 4,597,792 | A | 7/1986 | Webster |
| 4,626,294 | A | 12/1986 | Sanders, Jr. |
| 4,647,321 | A | 3/1987 | Adam |
| 4,661,172 | A | 4/1987 | Skinner et al. |
| 4,667,497 | A | 5/1987 | Oslin et al. |
| 4,689,090 | A | 8/1987 | Sawtell et al. |
| 4,710,246 | A | 12/1987 | La Caer et al. |
| 4,713,216 | A | 12/1987 | Higashi et al. |

(Continued)

FOREIGN PATENT DOCUMENTS

| | | | |
|---|---|---|---|
| CN | 1436870 | A | 8/2003 |

(Continued)

OTHER PUBLICATIONS

Official Search Report of the European Patent Office in counterpart foreign Application No. 09251026 filed Mar. 31, 2009.

(Continued)

*Primary Examiner*—Jessica L Ward
*Assistant Examiner*—Alexander Polyansky
(74) *Attorney, Agent, or Firm*—Kinney & Lange, P.A.

(57) ABSTRACT

High temperature heat treatable aluminum alloys that can be used at temperatures from about −420° F. (−251° C.) up to about 650° F. (343° C.) are described. The alloys are strengthened by dispersion of particles based on the $L1_2$ intermetallic compound $Al_3X$. These alloys comprise aluminum, copper, magnesium, at least one of scandium, erbium, thulium, ytterbium, and lutetium; and at least one of gadolinium, yttrium, zirconium, titanium, hafnium, and niobium. Lithium is an optional alloying element.

4 Claims, 8 Drawing Sheets

U.S. PATENT DOCUMENTS

| | | | | |
|---|---|---|---|---|
| 4,755,221 | A | | 7/1988 | Paliwal et al. |
| 4,853,178 | A | | 8/1989 | Oslin |
| 4,865,806 | A | | 9/1989 | Skibo et al. |
| 4,874,440 | A | | 10/1989 | Sawtell et al. |
| 4,915,605 | A | | 4/1990 | Chan et al. |
| 4,927,470 | A | | 5/1990 | Cho |
| 4,933,140 | A | | 6/1990 | Oslin |
| 4,946,517 | A | | 8/1990 | Cho |
| 4,964,927 | A | | 10/1990 | Shiflet et al. |
| 4,988,464 | A | | 1/1991 | Riley |
| 5,032,352 | A | | 7/1991 | Meeks et al. |
| 5,053,084 | A | | 10/1991 | Masumoto et al. |
| 5,055,257 | A | * | 10/1991 | Chakrabarti et al. ..... 148/564 |
| 5,059,390 | A | | 10/1991 | Burleigh et al. |
| 5,066,342 | A | | 11/1991 | Rioja et al. |
| 5,076,340 | A | | 12/1991 | Bruski et al. |
| 5,076,865 | A | | 12/1991 | Hashimoto et al. |
| 5,130,209 | A | | 7/1992 | Das et al. |
| 5,133,931 | A | | 7/1992 | Cho |
| 5,198,045 | A | | 3/1993 | Cho et al. |
| 5,211,910 | A | | 5/1993 | Pickens et al. |
| 5,226,983 | A | | 7/1993 | Skinner et al. |
| 5,256,215 | A | | 10/1993 | Horimura |
| 5,308,410 | A | | 5/1994 | Horimura et al. |
| 5,312,494 | A | | 5/1994 | Horimura et al. |
| 5,318,641 | A | | 6/1994 | Masumoto et al. |
| 5,397,403 | A | | 3/1995 | Horimura et al. |
| 5,458,700 | A | | 10/1995 | Masumoto et al. |
| 5,462,712 | A | | 10/1995 | Langan et al. |
| 5,480,470 | A | | 1/1996 | Miller et al. |
| 5,597,529 | A | | 1/1997 | Tack |
| 5,620,652 | A | | 4/1997 | Tack et al. |
| 5,624,632 | A | | 4/1997 | Baumann et al. |
| 5,882,449 | A | | 3/1999 | Waldron et al. |
| 6,139,653 | A | | 10/2000 | Fernandes et al. |
| 6,248,453 | B1 | | 6/2001 | Watson |
| 6,254,704 | B1 | | 7/2001 | Laul et al. |
| 6,258,318 | B1 | | 7/2001 | Lenczowski et al. |
| 6,309,594 | B1 | | 10/2001 | Meeks, III et al. |
| 6,312,643 | B1 | | 11/2001 | Upadhya et al. |
| 6,315,948 | B1 | | 11/2001 | Lenczowski et al. |
| 6,331,218 | B1 | | 12/2001 | Inoue et al. |
| 6,355,209 | B1 | | 3/2002 | Dilmore et al. |
| 6,368,427 | B1 | | 4/2002 | Sigworth |
| 6,506,503 | B1 | | 1/2003 | Mergen et al. |
| 6,517,954 | B1 | | 2/2003 | Mergen et al. |
| 6,524,410 | B1 | | 2/2003 | Kramer et al. |
| 6,531,004 | B1 | | 3/2003 | Lenczowski et al. |
| 6,562,154 | B1 | | 5/2003 | Rioja et al. |
| 6,630,008 | B1 | | 10/2003 | Meeks, III et al. |
| 6,702,982 | B1 | | 3/2004 | Chin et al. |
| 6,902,699 | B2 | | 6/2005 | Fritzemeier et al. |
| 6,918,970 | B2 | | 7/2005 | Lee et al. |
| 6,974,510 | B2 | | 12/2005 | Watson |
| 7,048,815 | B2 | | 5/2006 | Senkov et al. |
| 7,097,807 | B1 | | 8/2006 | Meeks, III et al. |
| 7,241,328 | B2 | | 7/2007 | Keener |
| 7,344,675 | B2 | | 3/2008 | Van Daam et al. |
| 2001/0054247 | A1 | | 12/2001 | Stall et al. |
| 2003/0192627 | A1 | | 10/2003 | Lee et al. |
| 2004/0046402 | A1 | | 3/2004 | Winardi |
| 2004/0055671 | A1 | | 3/2004 | Olson et al. |
| 2004/0089382 | A1 | | 5/2004 | Senkov et al. |
| 2004/0170522 | A1 | | 9/2004 | Watson |
| 2004/0191111 | A1 | | 9/2004 | Nie et al. |
| 2005/0147520 | A1 | | 7/2005 | Canzona |
| 2006/0011272 | A1 | | 1/2006 | Lin et al. |
| 2006/0093512 | A1 | | 5/2006 | Pandey |
| 2006/0172073 | A1 | | 8/2006 | Groza et al. |
| 2006/0269437 | A1 | | 11/2006 | Pandey |
| 2007/0048167 | A1 | | 3/2007 | Yano |
| 2007/0062669 | A1 | | 3/2007 | Song et al. |
| 2008/0066833 | A1 | | 3/2008 | Lin et al. |

FOREIGN PATENT DOCUMENTS

| | | | |
|---|---|---|---|
| CN | 101205578 | A | 6/2008 |
| EP | 0 208 631 | A1 | 6/1986 |
| EP | 0 584 596 | A2 | 3/1994 |
| EP | 1 111 079 | A1 | 6/2001 |
| EP | 1170394 | A2 | 1/2002 |
| EP | 1 249 303 | A1 | 10/2002 |
| EP | 1439239 | A1 | 7/2004 |
| EP | 1 471 157 | A1 | 10/2004 |
| EP | 1 111 078 | B1 | 9/2006 |
| EP | 1 728 881 | A2 | 12/2006 |
| EP | 1 788 102 | A1 | 5/2007 |
| FR | 2 656 629 | A1 | 12/1990 |
| FR | 2843754 | A1 | 2/2004 |
| JP | 04218638 | A | 8/1992 |
| JP | 9104940 | A | 4/1997 |
| JP | 9279284 | A | 10/1997 |
| JP | 11156584 | A | 6/1999 |
| JP | 2000119786 | A | 4/2000 |
| JP | 2007188878 | A | 7/2007 |
| RU | 2001144 | C1 | 10/1993 |
| RU | 2001145 | C1 | 10/1993 |
| WO | 90 02620 | A1 | 3/1990 |
| WO | 91 10755 | A2 | 7/1991 |
| WO | WO9111540 | A1 | 8/1991 |
| WO | WO9532074 | A2 | 11/1995 |
| WO | WO 96/10099 | | 4/1996 |
| WO | WO9833947 | A1 | 8/1998 |
| WO | 0037696 | A1 | 6/2000 |
| WO | 02 29139 | A2 | 4/2002 |
| WO | 03 052154 | A1 | 6/2003 |
| WO | 03085145 | A2 | 10/2003 |
| WO | 03085146 | A1 | 10/2003 |
| WO | 03 104505 | A2 | 12/2003 |
| WO | 2004 005562 | A2 | 1/2004 |
| WO | 2004046402 | A2 | 6/2004 |
| WO | 2005 045080 | A1 | 5/2005 |
| WO | 2005047554 | A1 | 5/2005 |

OTHER PUBLICATIONS

Cook, R., et al. "Aluminum and Aluminum Alloy Powders for P/M Applications." The Aluminum Powder Company Limited, Ceracon Inc.

"Aluminum and Aluminum Alloys." ASM Specialty Handbook. 1993. ASM International. p. 559.

ASM Handbook, vol. 7 ASM International, Materials Park, OH (1993) p. 396.

Gangopadhyay, A.K., et al. "Effect of rare-earth atomic radius on the devitrification of AI88RE8Ni4 amorphous alloys." Philosophical Magazine A, 2000, vol. 80, No. 5, pp. 1193-1206.

Riddle, Y.W., et al. "Improving Recrystallization Resistance in WRought Aluminum Alloys with Scandium Addition." Lightweight Alloys for Aerospace Applications VI (pp. 26-39), 2001 TMS Annual Meeting, New Orleans, Louisiana, Feb. 11-15, 2001.

Baikowski Malakoff Inc. "The many uses of High Purity Alumina." Technical Specs. http://www.baikowskimalakoff.com/pdf/Rc-Ls.pdf (2005).

Lotsko, D.V., et al. "Effect of small additions of transition metals on the structure of Al-Zn-Mg-Zr-Sc alloys." New Level of Properties. Advances in Insect Physiology. Academic Press, vol. 2, Nov. 4, 2002. pp. 535-536.

Neikov, O.D., et al. "Properties of rapidly solidified powder aluminum alloys for elevated temperatures produced by water atomization." Advances in Powder Metallurgy & Particulate Materials. 2002. pp. 7-14-7-27.

Harada, Y. et al. "Microstructure of Al3Sc with ternary transition-metal additions." Materials Science and Engineering A329-331 (2002) 686-695.

Unal, A. et al. "Gas Atomization" from the section "Production of Aluminum and Aluminum-Alloy Powder" ASM Handbook, vol. 7. 2002.

Riddle, Y.W., et al. "A Study of Coarsening, Recrystallization, and Morphology of Microstructure in Al-Sc-(Zr)-(Mg) Alloys." Metallurgical and Materials Transactions A. vol. 35A, Jan. 2004. pp. 341-350.

Mil'Man, Y.V. et al. "Effect of Additional Alloying with Transition Metals on the STructure of an Al-7.1 Zn-1.3 Mg-0.12 Zr Alloy." Metallofizika I Noveishie Teknohologii, 26 (10), 1363-1378, 2004.

Tian, N. et al. "Heating rate dependence of glass transition and primary crystallization of Al88Gd6Er2Ni4 metallic glass." Scripta Materialia 53 (2005) pp. 681-685.

Litynska, L. et al. "Experimental and theoretical characterization of Al3Sc precipitates in Al-Mg-Si-Cu-Sc-Zr alloys." Zeitschrift Fur Metallkunde. vol. 97, No. 3. Jan. 1, 2006. pp. 321-324.

Rachek, O.P. "X-ray diffraction study of amorphous alloys Al-Ni-Ce-Sc with using Ehrenfest's formula." Journal of Non-Crystalline Solids 352 (2006) pp. 3781-3786.

Pandey A B et al, "High Strength Discontinuously Reinforced Aluminum For Rocket Applications," Affordable Metal Matrix Composites For High Performance Applications. Symposia Proceedings, TMS (The Minerals, Metals & Materials Society), US, No. 2nd, Jan. 1, 2008, pp. 3-12.

Niu, Ben et al. "Influence of addition of 1-15 erbium on microstructure and crystallization behavior of Al-Ni-Y amorphous alloy" Zhongguo Xitu Xuebao, 26(4), pp. 450-454. 2008.

Riddle, Y.W., et al. "Recrystallization Performance of AA7050 Varied with Sc and Zr." Materials Science Forum. 2000. pp. 799-804.

Lotsko, D.V., et al. "High-strength aluminum-based alloys hardened by quasicrystalline nanoparticles." Science for Materials in the Frontier of Centuries: Advantages and Challenges, International Conference: Kyiv, Ukraine. Nov. 4-8, 2002. vol. 2. pp. 371-372.

Hardness Conversion Table. Downloaded from http://www.gordonengland.co.uk/hardness/hardness_conversion_2m.htm.

* cited by examiner

HEAT TREATABLE $L1_2$ ALUMINUM ALLOYS

CROSS-REFERENCE TO RELATED APPLICATIONS

This application is related to the following applications that are filed on even date herewith and are assigned to the same assignee: $L1_2$ ALUMINUM ALLOYS WITH BIMODAL AND TRIMODAL DISTRIBUTION, Ser. No. 12/148,395; DISPERSION STRENGTHENED $L1_2$ ALUMINUM ALLOYS, Ser. No. 12/148,432; HEAT TREATABLE $L1_2$ ALUMINUM ALLOYS, Ser. No. 12/148,383; HIGH STRENGTH $L1_2$ ALUMINUM ALLOYS, Ser. No. 12/148,394; HEAT TREATABLE $L1_2$ ALUMINUM ALLOYS, Ser. No. 12/148,396, HIGH STRENGTH $L1_2$ ALUMINUM ALLOYS, Ser. No. 12/148,387; HIGH STRENGTH ALUMINUM ALLOYS WITH $L1_2$ PRECIPITATES, Ser. No. 12/148,426; HIGH STRENGTH $L1_2$ ALUMINUM ALLOYS, Ser. No. 12/148,459; and $L1_2$ STRENGTHENED AMORPHOUS ALUMINUM ALLOYS, Ser. No. 12/148,458.

BACKGROUND

The present invention relates generally to aluminum alloys and more specifically to heat treatable aluminum alloys produced by melt processing and strengthened by $L1_2$ phase dispersions.

The combination of high strength, ductility, and fracture toughness, as well as low density, make aluminum alloys natural candidates for aerospace and space applications. However, their use is typically limited to temperatures below about 300° F. (149° C.) since most aluminum alloys start to lose strength in that temperature range as a result of coarsening of strengthening precipitates.

The development of aluminum alloys with improved elevated temperature mechanical properties is a continuing process. Some attempts have included aluminum-iron and aluminum-chromium based alloys such as Al—Fe—Ce, Al—Fe—V—Si, Al—Fe—Ce—W, and Al—Cr—Zr—Mn that contain incoherent dispersoids. These alloys, however, also lose strength at elevated temperatures due to particle coarsening. In addition, these alloys exhibit ductility and fracture toughness values lower than other commercially available aluminum alloys.

Other attempts have included the development of mechanically alloyed Al—Mg and Al—Ti alloys containing ceramic dispersoids. These alloys exhibit improved high temperature strength due to the particle dispersion, but the ductility and fracture toughness are not improved.

U.S. Pat. No. 6,248,453 discloses aluminum alloys strengthened by dispersed $Al_3X$ $L1_2$ intermetallic phases where X is selected from the group consisting of Sc, Er, Lu, Yb, Tm, and U. The $Al_3X$ particles are coherent with the aluminum alloy matrix and are resistant to coarsening at elevated temperatures. The improved mechanical properties of the disclosed dispersion strengthened $L1_2$ aluminum alloys are stable up to 572° F. (300° C.). In order to create aluminum alloys containing fine dispersions of $Al_3X$ $L1_2$ particles, the alloys need to be manufactured by expensive rapid solidification processes with cooling rates in excess of $1.8\times10^3$ F/sec ($10^{3}$° C./sec). U.S. Patent Application Publication No. 2006/0269437 A1 discloses an aluminum alloy that contains scandium and other elements. While the alloy is effective at high temperatures, it is not capable of being heat treated using a conventional age hardening mechanism.

Heat treatable aluminum alloys strengthened by coherent $L1_2$ intermetallic phases produced by standard, inexpensive melt processing techniques would be useful.

SUMMARY

The present invention is heat treatable aluminum alloys that can be cast, wrought, or formed by rapid solidification, and thereafter heat treated. The alloys can achieve high temperature performance and can be used at temperatures up to about 650° F. (343° C.).

These alloys comprise copper, magnesium, lithium and an $Al_3X$ $L1_2$ dispersoid where X is at least one first element selected from scandium, erbium, thulium, ytterbium, and lutetium, and at least one second element selected from gadolinium, yttrium, zirconium, titanium, hafnium, and niobium. The balance is substantially aluminum.

The alloys have less than about 1.0 weight percent total impurities.

The alloys are formed by a process selected from casting, deformation processing and rapid solidification. The alloys are then heat treated at a temperature of from about 900° F. (482° C.) to about 1100° F. (593° C.) for between about 30 minutes and four hours, followed by quenching in water, and thereafter aged at a temperature from about 200° F. (93° C.) to about 600° F. (315° C.) for about two to about forty-eight hours.

DETAILED DESCRIPTION

The alloys of this invention are based on the aluminum, copper, magnesium, lithium system. The amount of copper in these alloys ranges from about 1.0 to about 8.0 weight percent, more preferably about 2.0 to about 7.0 weight percent, and even more preferably about 3.5 to about 6.5 weight percent. The amount of magnesium in these alloys ranges from about 0.2 to about 4.0 weight percent, more preferably about 0.4 to about 3.0 weight percent, and even more preferably about 0.5 to about 2.0 weight percent. The amount of lithium in these alloys ranges from about 0.5 to about 3.0 weight percent, more preferably about 1.0 to about 2.5 weight percent, and even more preferably about 1.0 to about 2.0 weight percent.

Copper, magnesium and lithium are completely soluble in the composition of the inventive alloys discussed herein. Aluminum magnesium lithium alloys are heat treatable with $L1_2$ $Al_3Li$ (δ'), $Al_2LiMg$, $Al_2CuMg$ (S') and $Al_2CuLi$ precipitating following a solution heat treatment, quench and age process. These phases precipitate as coherent second phases in the aluminum magnesium lithium solid solution matrix. Also, in the solid solutions are dispersions of $Al_3X$ having an $L1_2$ structure where X is at least one first element selected from scandium, erbium, thulium, ytterbium, and lutetium and at least one second element selected from gadolinium, yttrium, zirconium, titanium, hafnium, and niobium.

Figure 1:
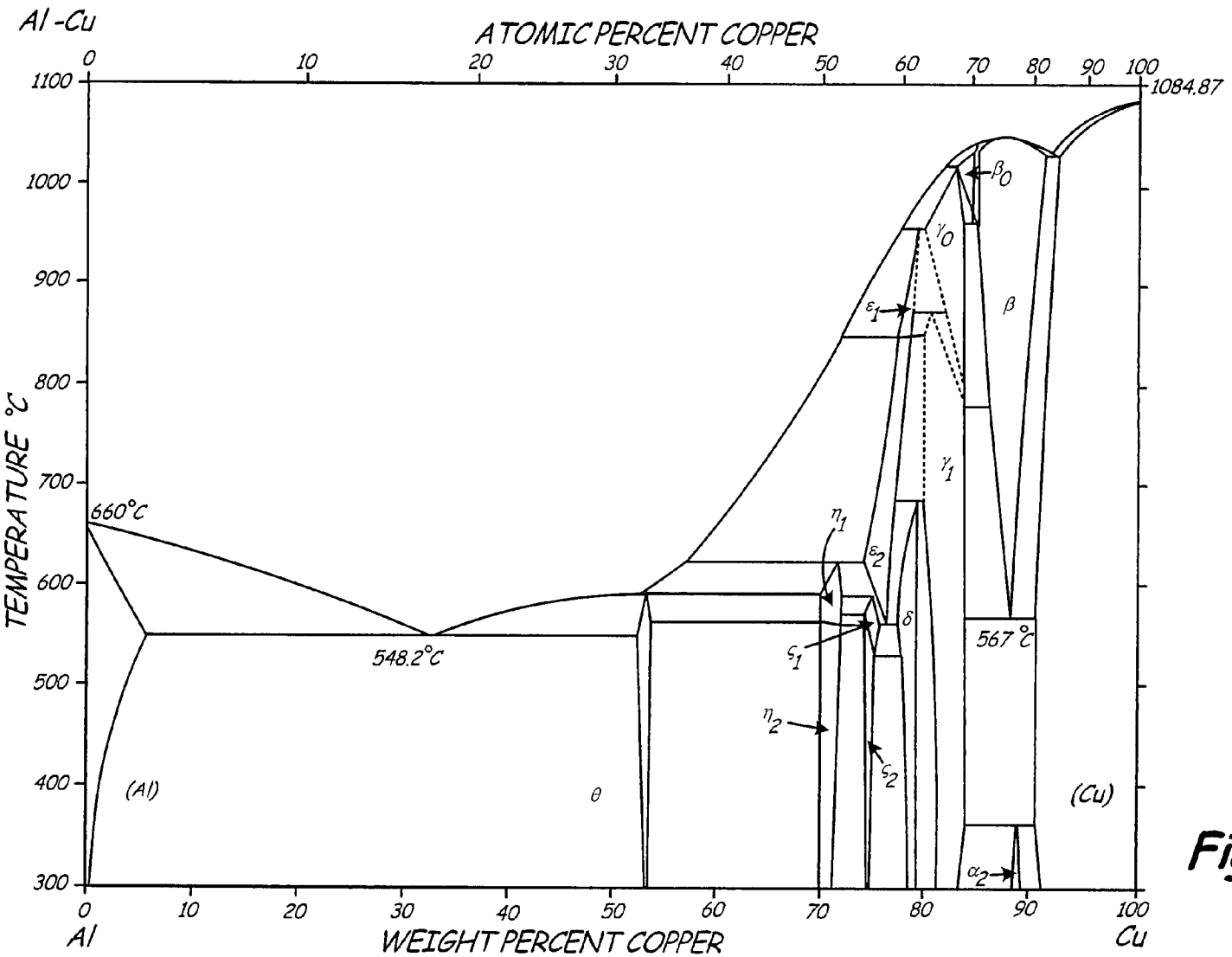
FIG. 1 is an aluminum copper phase diagram.

The aluminum copper phase diagram is shown in FIG. 1. The aluminum copper binary system is a eutectic alloy system with a eutectic reaction at 31.2 weight percent magnesium and 1018° F. (548.2° C.). Copper has maximum solid solubility of 6 weight percent in aluminum at 1018° F. (548.2° C.) which can be extended further by rapid solidification processing. Copper provides a considerable amount of precipitation strengthening in aluminum by precipitation of fine second phases. The present invention is focused on hypoeutectic alloy composition ranges.

Figure 2:
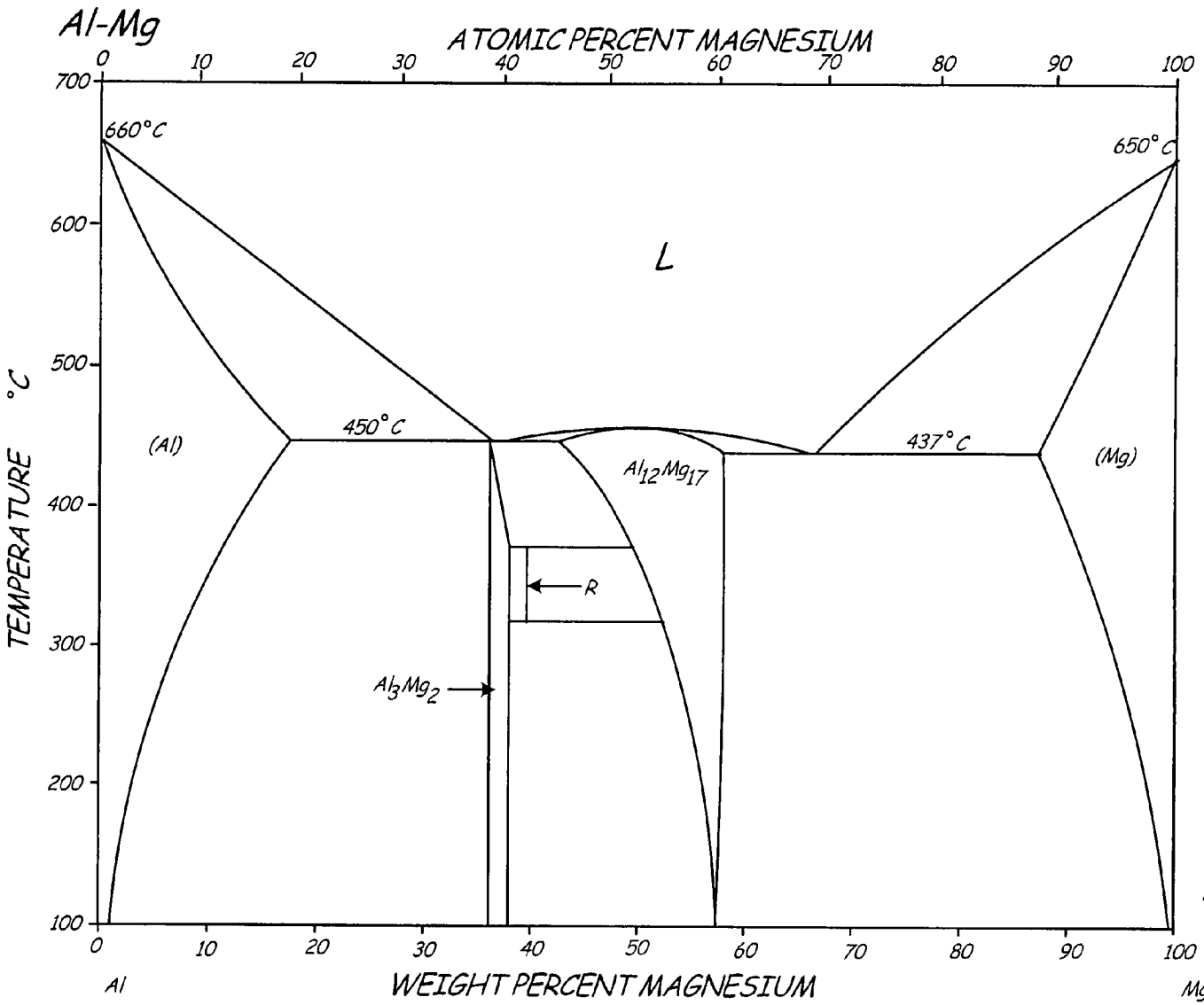
FIG. 2 is an aluminum magnesium phase diagram.

The aluminum magnesium phase diagram is shown in FIG. 2. The binary system is a eutectic alloy system with a eutectic reaction at 36 weight percent magnesium and 842° F. (450° C.). Magnesium has maximum solid solubility of 16 weight percent in aluminum at 842° F. (450° C.) which can be extended further by rapid solidification processing. Magnesium provides substantial solid solution strengthening in aluminum. In addition, magnesium provides precipitation strengthening through precipitation of $Al_2CuMg$ (S') phase in the presence of copper.

Figure 3:
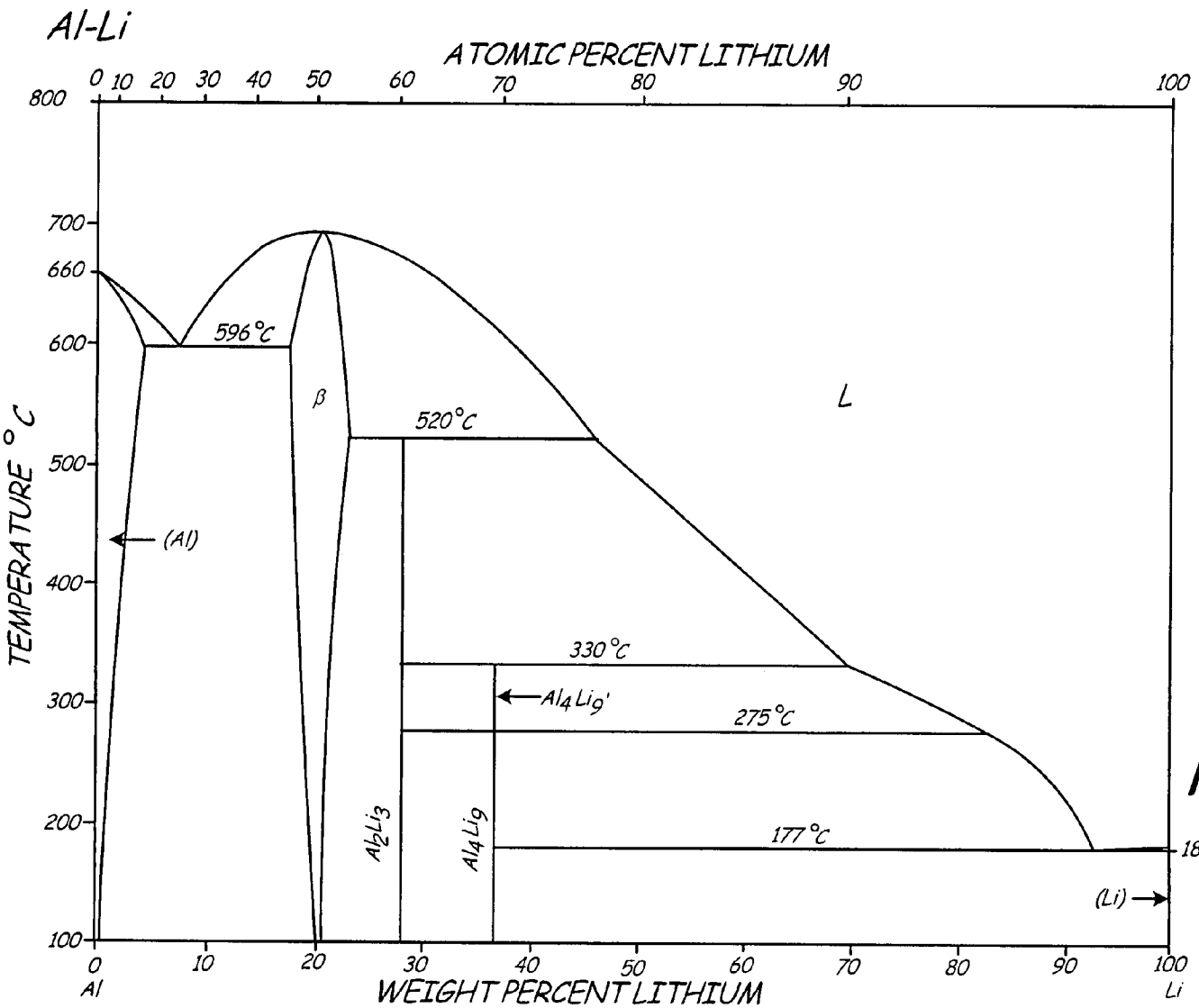
FIG. 3 is an aluminum lithium phase diagram.

The aluminum lithium phase diagram is shown in FIG. 3. The binary system is a eutectic alloy system with a eutectic reaction at 8 weight percent magnesium and 1104° F. (596° C.). Lithium has maximum solid solubility of about 4.5 weight percent in aluminum at 1104° F. (596° C.). Lithium has lesser solubility in aluminum in the presence of magnesium compared to when magnesium is absent. Therefore, lithium provides significant precipitation strengthening through precipitation of $Al_3Li$ (δ') phase. Lithium in addition provides reduced density and increased modulus in aluminum. In the presence of magnesium and copper, lithium forms ternary precipitates based on $Al_2CuLi$ and $Al_2MgLi$.

The alloys of this invention contain phases consisting of primary aluminum, aluminum copper solid solutions, aluminum magnesium solid solutions, and aluminum lithium solid solutions. In the solid solutions are dispersions of $Al_3X$ having an $L1_2$ structure where X is at least one element selected from scandium, erbium, thulium, ytterbium, and lutetium. Also present is at least one element selected from gadolinium, yttrium, zirconium, titanium, hafnium, and niobium.

Exemplary aluminum alloys of this invention include, but are not limited to (in weight percent):

Al-(1-8)Cu-(0.2-4)Mg-(0.5-3.0)Li-(0.1-0.5)Sc-(0.1-4.0)Gd;

Al-(1-8)Cu-(0.2-4)Mg-(0.5-3.0)Li-(0.1-6)Er-(0.1-4.0)Gd;

Al-(1-8)Cu-(0.2-4)Mg-(0.5-3.0)Li-(0.1-10)Tm-(0.1-4.0)Gd;

Al-(1-8)Cu-(0.2-4)Mg-(0.5-3.0)Li-(0.1-15)Yb-(0.1-4.0)Gd;

Al-(1-8)Cu-(0.2-4)Mg-(0.5-3.0)Li-(0.1-12)Lu-(0.1-4.0)Gd;

Al-(1-8)Cu-(0.2-4)Mg-(0.5-3.0)Li-(0.1-0.5)Sc-(0.1-4.0)Y;

Al-(1-8)Cu-(0.2-4)Mg-(0.5-3.0)Li-(0.1-6)Er-(0.1-4.0)Y;

Al-(1-8)Cu-(0.2-4)Mg-(0.5-3.0)Li-(0.1-10)Tm-(0.1-4.0)Y;

Al-(1-8)Cu-(0.2-4)Mg-(0.5-3.0)Li-(0.1-15)Yb-(0.1-4.0)Y;

Al-(1-8)Cu-(0.2-4)Mg-(0.5-3.0)Li-(0.1-12)Lu-(0.1-4.0)Y;

Al-(1-8)Cu-(0.2-4)Mg-(0.5-3.0)Li-(0.1-0.5)Sc-(0.05-1.0)Zr;

Al-(1-8)Cu-(0.2-4)Mg-(0.5-3.0)Li-(0.1-6)Er-(0.05-1.0)Zr;

Al-(1-8)Cu-(0.2-4)Mg-(0.5-3.0)Li-(0.1-10)Tm-(0.05-1.0)Zr;

Al-(1-8)Cu-(0.2-4)Mg-(0.5-3.0)Li-(0.1-15)Yb-(0.05-1.0)Zr;

Al-(1-8)Cu-(0.2-4)Mg-(0.5-3.0)Li-(0.1-12)Lu-(0.05-1.0)Zr;

Al-(1-8)Cu-(0.2-4)Mg-(0.5-3.0)Li-(0.1-0.5)Sc-(0.05-2.0)Ti;

Al-(1-8)Cu-(0.2-4)Mg-(0.5-3.0)Li-(0.1-0.5)Er-(0.05-2.0)Ti;

Al-(1-8)Cu-(0.2-4)Mg-(0.5-3.0)Li-(0.1-10)Tm-(0.05-2.0)Ti;

Al-(1-8)Cu-(0.2-4)Mg-(0.5-3.0)Li-(0.1-15)Yb-(0.05-2.0)Ti;

Al-(1-8)Cu-(0.2-4)Mg-(0.5-3.0)Li-(0.1-4)-Lu-(0.05-2.0)Ti;

Al-(1-8)Cu-(0.2-4)Mg-(0.5-3.0)Li-(0.1-0.5)Sc-(0.05-2.0)Hf;

Al-(1-8)Cu-(0.2-4)Mg-(0.5-3.0)Li-(0.1-6)Er-(0.05-2.0)Hf;

Al-(1-8)Cu-(0.2-4)Mg-(0.5-3.0)Li-(0.1-10)Tm-(0.05-2.0)Hf;

Al-(1-8)Cu-(0.2-4)Mg-(0.5-3.0)Li-(0.1-15)Yb-(0.05-2.0)Hf;

Al-(1-8)Cu-(0.2-4)Mg-(0.5-3.0)Li-(0.1-12)Lu-(0.05-2.0)Hf;

Al-(1-8)Cu-(0.2-4)Mg-(0.5-3.0)Li-(0.1-0.5)Sc-(0.05-1.0)Nb;

Al-(1-8)Cu-(0.2-4)Mg-(0.5-3.0)Li-(0.1-6)Er-(0.05-1.0)Nb;

Al-(1-8)Cu-(0.2-4)Mg-(0.5-3.0)Li-(0.1-10)Tm-(0.05-1.0)Nb;

Al-(1-8)Cu-(0.2-4)Mg-(0.5-3.0)Li-(0.1-15)Yb-(0.05-1.0)Nb; and

Al-(1-8)Cu-(0.2-4)Mg-(0.5-3.0)Li-(0.1-12)Lu-(0.05-1.0)Nb.

Preferred examples of similar alloys to these are alloys with about 2.0 to about 7.0 weight percent copper, alloys with about 0.4 to about 3.0 weight percent magnesium, and alloys with about 1.0 to about 2.5 weight percent lithium.

In the inventive aluminum based alloys disclosed herein, scandium, erbium, thulium, ytterbium, and lutetium are potent strengtheners that have low diffusivity and low solubility in aluminum. All these element form equilibrium $Al_3X$ intermetallic dispersoids where X is at least one of scandium, erbium, ytterbium, lutetium, that have an $L1_2$ structure that is an ordered face centered cubic structure with the X atoms located at the corners and aluminum atoms located on the cube faces of the unit cell.

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). In the alloys of this invention these $Al_3Sc$ dispersoids are made stronger and more resistant to coarsening at elevated temperatures by adding suitable alloying elements such as gadolinium, yttrium, zirconium, titanium, hafnium, niobium, or combinations thereof, that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Er$ to coarsening. Additions of copper increase the strength of alloys through precipitation of $Al_2Cu$ (θ') and $Al_2CuMg$ (S') phases. In the alloys of this invention, these $Al_3Er$ dispersoids are made stronger and more resistant to coarsening at elevated temperatures by adding suitable alloying elements such as gadolinium, yttrium, zirconium, titanium, hafnium, niobium, or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Tm$ to coarsening. Additions of copper increase the strength of alloys through precipitation of $Al_2Cu$ (θ') and $Al_2CuMg$ (S') phases. In the alloys of this invention these $Al_3Tm$ dispersoids are made stronger and more resistant to coarsening at elevated temperatures by adding suitable alloying elements such as gadolinium, yttrium, zirconium, titanium, hafnium, niobium, or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 nm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Yb$ to coarsening. Additions of copper increase the strength of alloys through precipitation of $Al_2Cu$ (θ') and $Al_2CuMg$ (S') phases. In the alloys of this invention, these $Al_3Yb$ dispersoids are made stronger and more resistant to coarsening at elevated temperatures by adding suitable alloying elements such as gadolinium, yttrium, zirconium, titanium, hafnium, niobium, or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). Additions of magnesium in solid solution in aluminum increase the lattice parameter of the aluminum matrix, and decrease the lattice parameter mismatch further increasing the resistance of the $Al_3Lu$ to coarsening. Additions of copper increase the strength of alloys through precipitation of $Al_2Cu$ (θ') and $Al_2CuMg$ (S') phases. In the alloys of this invention, these $Al_3Lu$ dispersoids are made stronger and more resistant to coarsening at elevated temperatures by adding suitable alloying elements such as gadolinium, yttrium, zirconium, titanium, hafnium, niobium, or mixtures thereof that enter $Al_3Lu$ in solution.

Gadolinium forms metastable $Al_3Gd$ dispersoids in the aluminum matrix that are stable up to temperatures as high as about 842° F. (450° C.) due to their low diffusivity in aluminum. The $Al_3Gd$ dispersoids have a $D0_{19}$ structure in the equilibrium condition. Despite its large atomic size, gadolinium has fairly high solubility in the $Al_3X$ intermetallic dispersoids (where X is scandium, erbium, thulium, ytterbium or lutetium). Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $D0_{22}$ structure in the equilibrium condition. The metastable $Al_3Ti$ despersoids have a low diffusion coefficient which makes them thermally stable and highly resistant to coarsening. Titanium has a high solubility in the $Al_3X$ dispersoids allowing large amounts of titanium to substitute for X in the $Al_3X$ dispersoids, which result in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above mentioned $Al_3X$ dispersoides, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

$Al_3X$ $L1_2$ precipitates improve elevated temperature mechanical properties in aluminum alloys for two reasons. First, the precipitates are ordered intermetallic compounds. As a result, when the particles are sheared by glide dislocations during deformation, the dislocations separate into two partial dislocations separated by an anti-phase boundary on the glide plane. The energy to create the anti-phase boundary is the origin of the strengthening. Second, the cubic $L1_2$ crystal structure and lattice parameter of the precipitates are closely matched to the aluminum solid solution matrix. This results in a lattice coherency at the precipitate/matrix boundary that resists coarsening. The lack of an interphase boundary results in a low driving force for particle growth and resulting elevated temperature stability. Alloying elements in solid solution in the dispersed strengthening particles and in the aluminum matrix that tend to decrease the lattice mismatch between the matrix and particles will tend to increase the strengthening and elevated temperature stability of the alloy.

Copper has considerable solubility in aluminum at 1018° F. (548.2° C.), which decreases with a decrease in temperature. The aluminum copper alloy system provides considerable precipitation hardening response through precipitation of $Al_2Cu$ (θ') second phase. Magnesium has considerable solubility in aluminum at 842° F. (450° C.) which decreases with a decrease in temperature. The aluminum magnesium binary alloy system does not provide precipitation hardening, rather it provides substantial solid solution strengthening. When magnesium is added to aluminum copper alloy, it increases the precipitation hardening response of the alloy considerably through precipitation of $Al_2CuMg$ (S') phase. When the ratio of copper to magnesium is high, precipitation hardening occurs through precipitation of GP zones through coherent metastable $Al_2Cu$ (θ') to equilibrium $Al_2Cu$ (θ) phase. When the ratio of copper to magnesium is low, precipitation hardening occurs through precipitation of GP zones through coherent metastable $Al_2CuMg$ (S') to equilibrium $Al_2CuMg$ (S) phase. Lithium provides considerable strengthening through precipitation of coherent $Al_3Li$ (δ') phase. Lithium also forms $Al_2MgLi$ and $Al_2CuLi$ phases which provide additional strengthening when precipitated in desired size and shape. In addition, lithium reduces density and increases modulus of the aluminum alloys due to its lower density and higher modulus.

Figure 4:
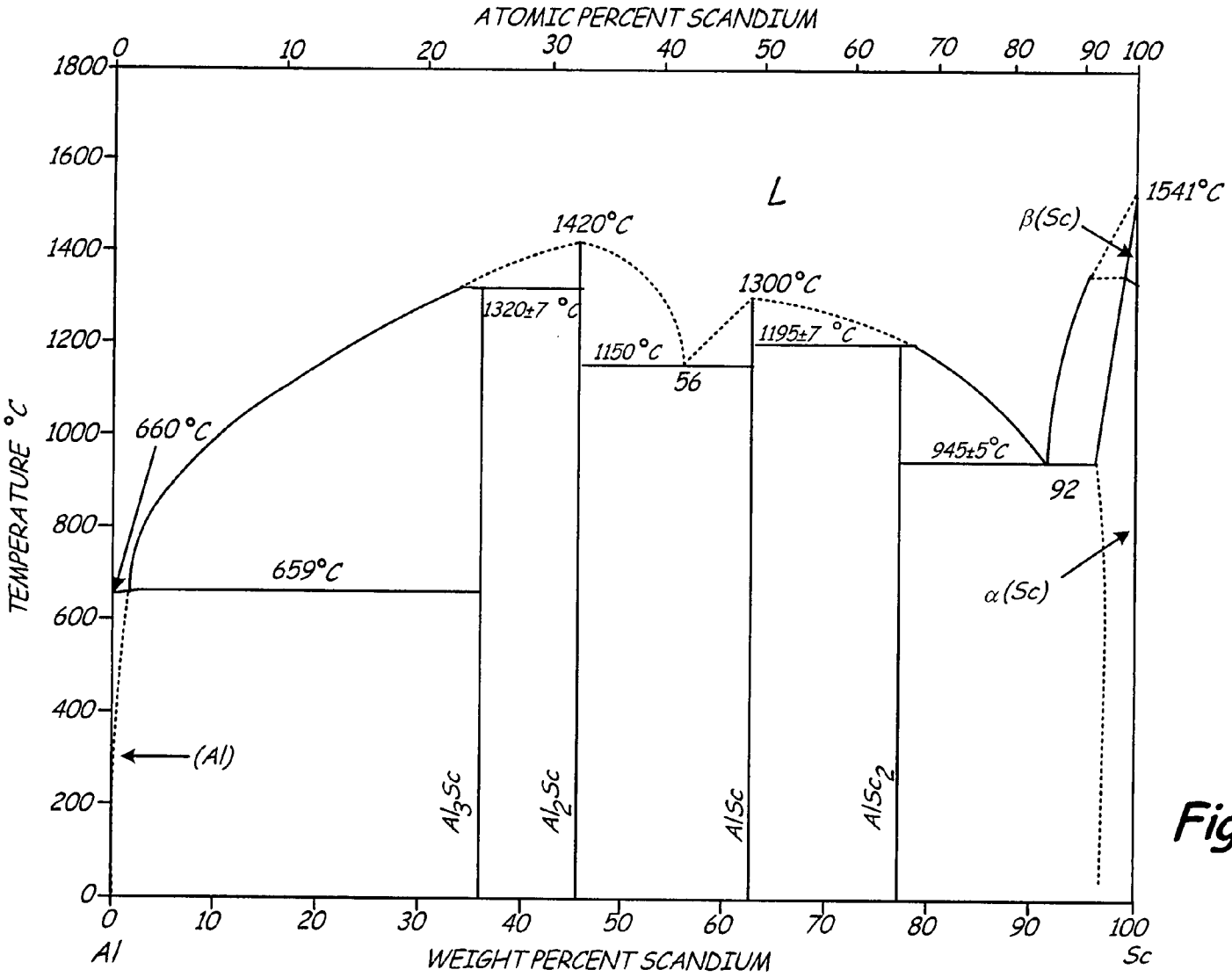
FIG. 4 is an aluminum scandium phase diagram.

The amount of scandium present in the alloys of this invention if any may vary from about 0.1 to about 0.5 weight percent, more preferably from about 0.1 to about 0.35 weight percent, and even more preferably from about 0.1 to about 0.25 weight percent. The Al—Sc phase diagram shown in FIG. 4 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment. Alloys with scandium in excess of the eutectic composition (hypereutectic alloys) can only retain scandium in solid solution by rapid solidification processing (RSP) where cooling rates are in excess of about $10^{3}$° C./second. Alloys with scandium in excess of the eutectic composition cooled normally will have a microstructure consisting of relatively large $Al_3Sc$ dispersoids in a finally divided aluminum-$Al_3Sc$ eutectic phase matrix.

Figure 5:
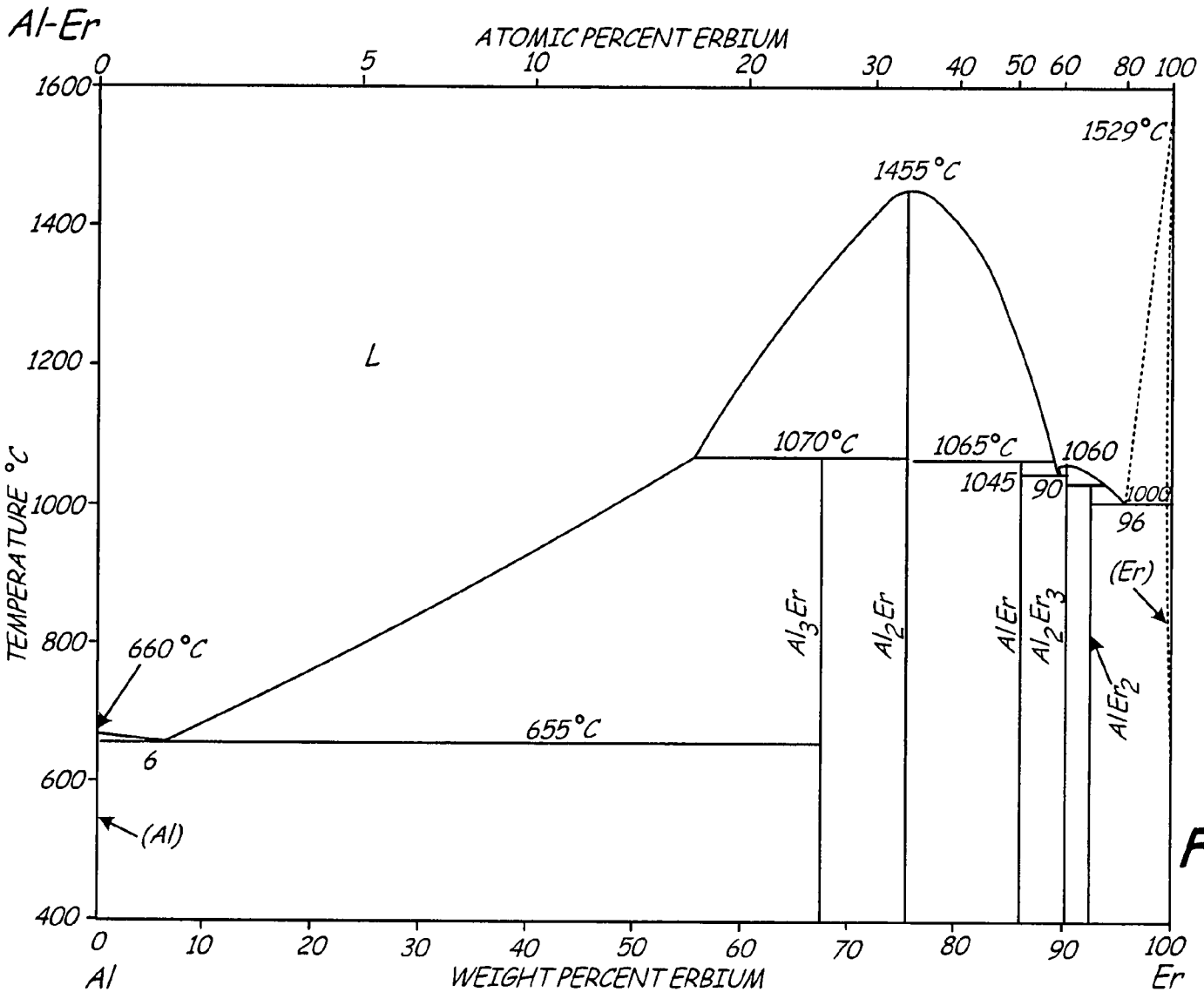
FIG. 5 is an aluminum erbium phase diagram.

The amount of erbium present in the alloys of this invention, if any, may vary from about 0.1 to about 6.0 weight percent, more preferably from about 0.1 to about 4.0 weight percent, and even more preferably from about 0.2 to about 2.0 weight percent. The Al—Er phase diagram shown in FIG. 5 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment. Alloys with erbium in excess of the eutectic composition can only retain erbium in solid solution by rapid solidification processing (RSP) where cooling rates are in excess of about $10^{3}$° C./second. Alloys with erbium in excess of the eutectic composition (hypereutectic alloys) cooled normally will have a microstructure consisting of relatively large $Al_3Er$ dispersoids in a finely divided aluminum-$Al_3Er$ eutectic phase matrix.

Figure 6:
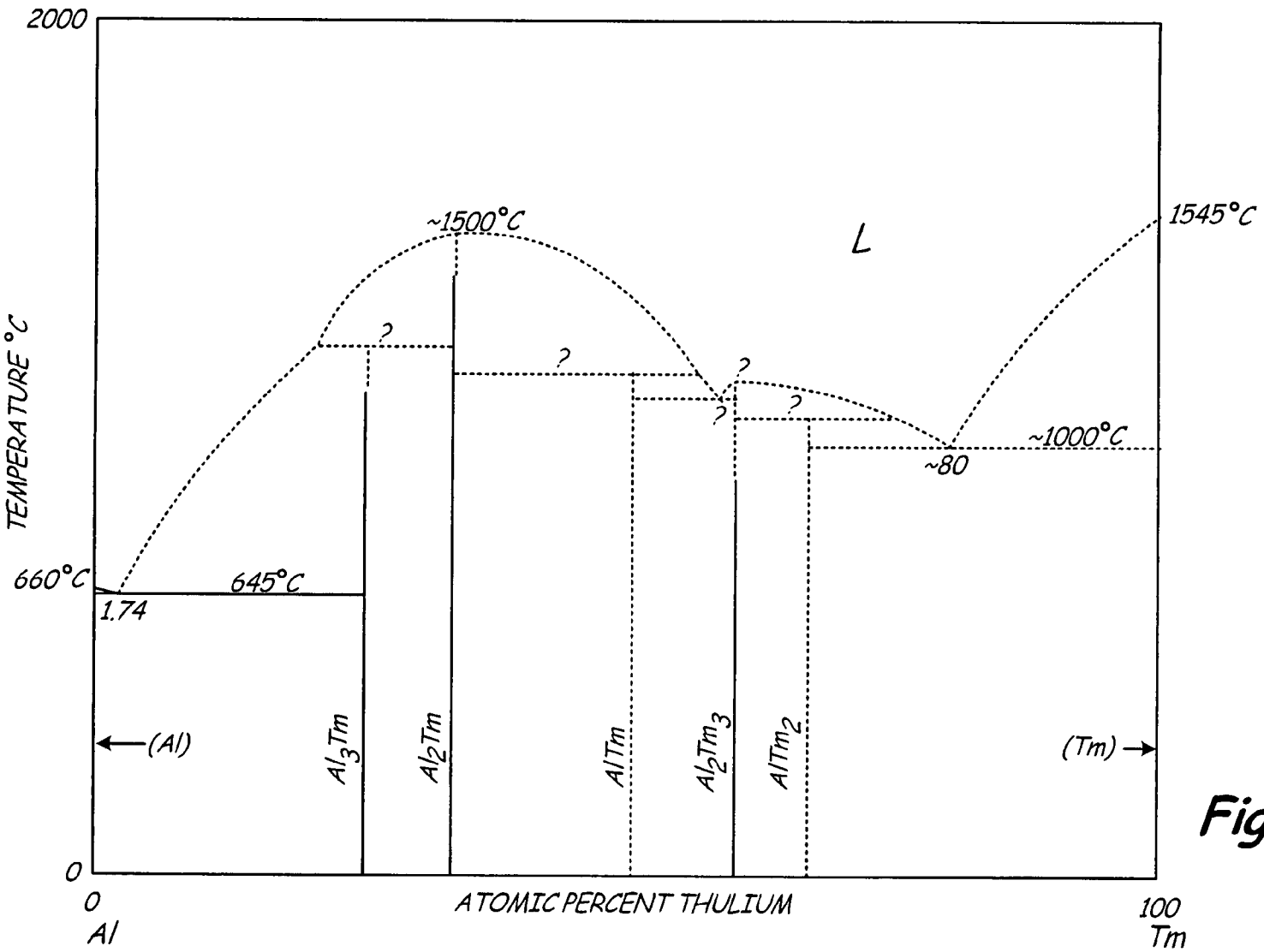
FIG. 6 is an aluminum thulium phase diagram.

The amount of thulium present in the alloys of this invention, if any, may vary from about 0.1 to about 10.0 weight percent, more preferably from about 0.2 to about 6.0 weight percent, and even more preferably from about 0.2 to about 4.0 weight percent. The Al—Tm phase diagram shown in FIG. 6 indicates a eutectic reaction at about 10 weight percent thulium at about 1193° F. (645° C.). Thulium forms $Al_3Tm$ dispersoids in the aluminum matrix that have an $L1_2$ structure in the equilibrium condition. The $Al_3Tm$ dispersoids have a low diffusion coefficient which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment. Alloys with thulium in excess of the eutectic composition can only retain Tm in solid solution by rapid solidification processing (RSP) where cooling rates are in excess of about $10^{3}$° C./second.

Figure 7:
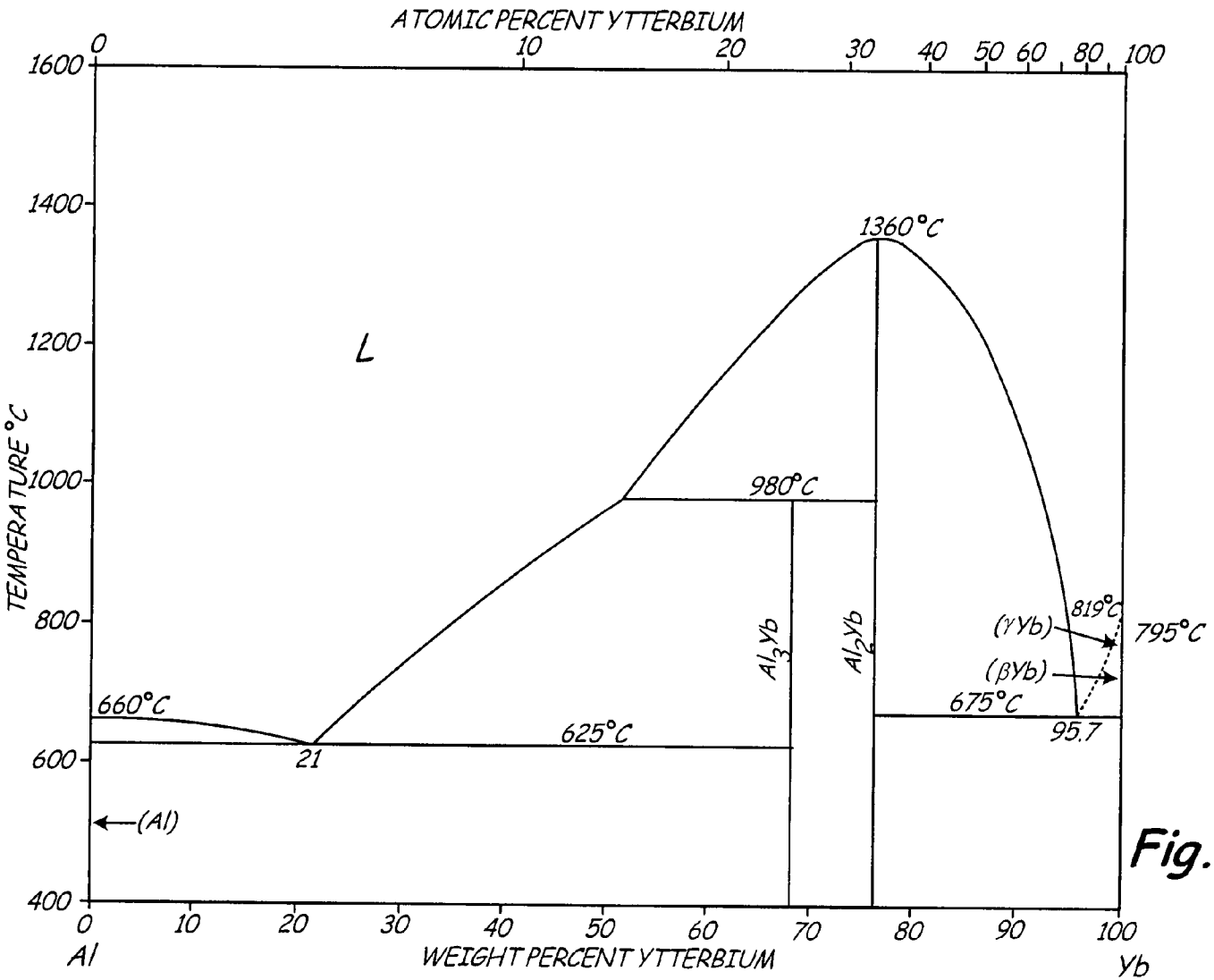
FIG. 7 is an aluminum ytterbium phase diagram.

The amount of ytterbium present in the alloys of this invention, if any, may vary from about 0.1 to about 15.0 weight percent, more preferably from about 0.2 to about 8.0 weight percent, and even more preferably from about 0.2 to about 4.0 weight percent. The Al—Yb phase diagram shown in FIG. 7 indicates a eutectic reaction at about 21 weight percent ytterbium at about 1157° F. (625° C.). Aluminum alloys with less than about 21 weight percent ytterbium can be quenched from the melt to retain ytterbium in solid solution that may precipitate as dispersed $L1_2$ intermetallic $Al_3Yb$ following an aging treatment. Alloys with ytterbium in excess of the eutectic composition can only retain ytterbium in solid solution by rapid solidification processing (RSP) where cooling rates are in excess of about $10^{3}$° C. per second. Alloys with ytterbium in excess of the eutectic composition cooled normally will have a microstructure consisting of relatively large $Al_3Yb$ dispersoids in a finally divided aluminum-$Al_3Yb$ eutectic phase matrix.

Figure 8:
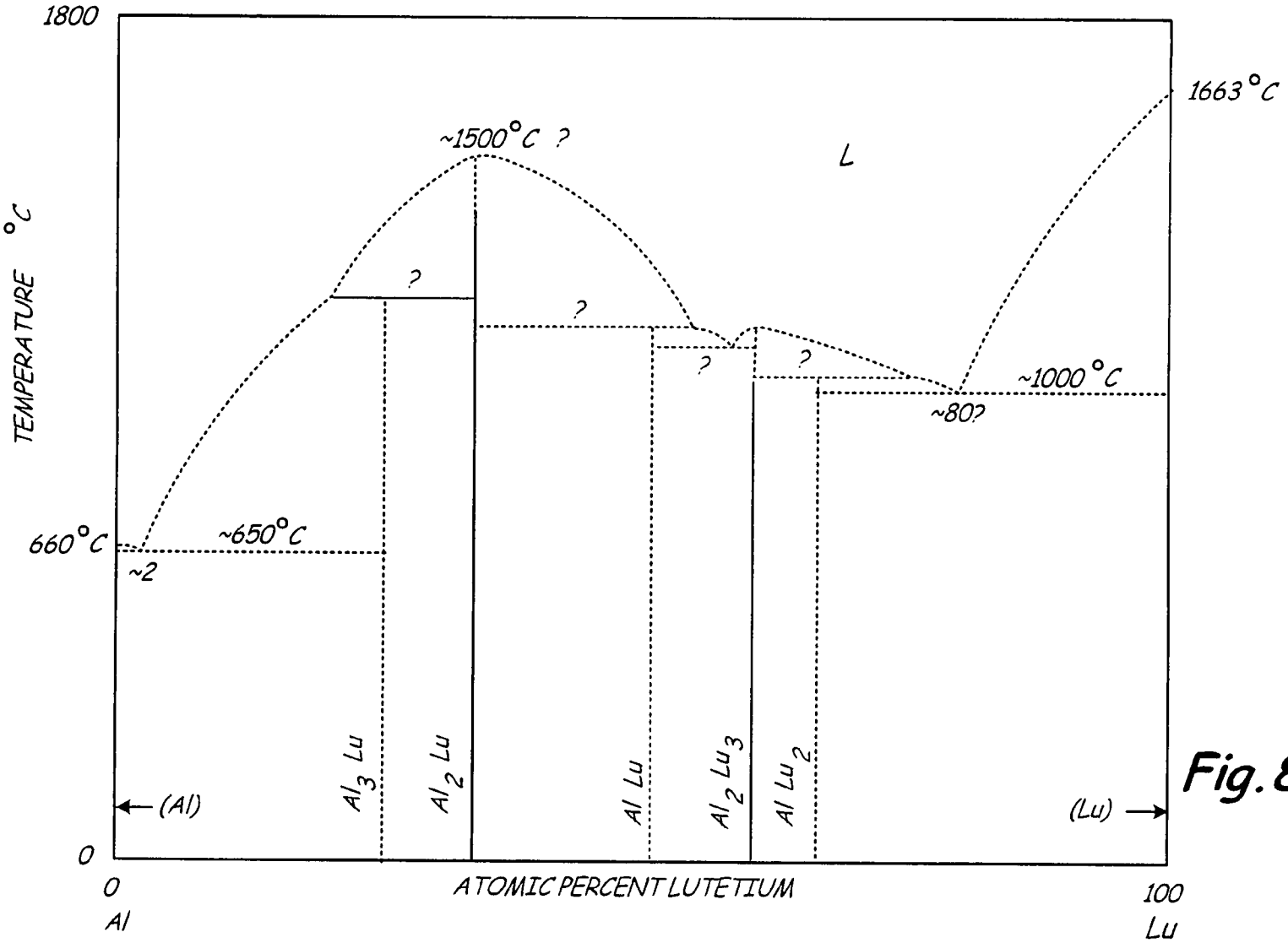
FIG. 8 is an aluminum lutetium phase diagram.

The amount of lutetium present in the alloys of this invention, if any, may vary from about 0.1 to about 12.0 weight percent, more preferably from about 0.2 to about 8.0 weight percent, and even more preferably from about 0.2 to about 4.0 weight percent. The Al—Lu phase diagram shown in FIG. 8 indicates a eutectic reaction at about 11.7 weight percent Lu at about 1202° F. (650° C.). Aluminum alloys with less than about 11.7 weight percent lutetium can be quenched from the melt to retain Lu in solid solution that may precipitate as dispersed $L1_2$ intermetallic $Al_3Lu$ following an aging treatment. Alloys with Lu in excess of the eutectic composition can only retain Lu in solid solution by rapid solidification processing (RSP) where cooling rates are in excess of about $10^{3}$° C./second. Alloys with lutetium in excess of the eutectic composition cooled normally will have a microstructure consisting of relatively large $Al_3Lu$ dispersoids in a finely divided aluminum-$Al_3Lu$ eutectic phase matrix.

The amount of gadolinium present in the alloys of this invention, if any, may vary from about 0.1 to about 4 weight percent, more preferably from 0.2 to about 2 weight percent, and even more preferably from about 0.5 to about 2 weight percent.

The amount of yttrium present in the alloys of this invention, if any, may vary from about 0.1 to about 4 weight percent, more preferably from 0.2 to about 2 weight percent, and even more preferably from about 0.5 to about 2 weight percent.

The amount of zirconium present in the alloys of this invention, if any, may vary from about 0.05 to about 1 weight percent, more preferably from 0.1 to about 0.75 weight percent, and even more preferably from about 0.1 to about 0.5 weight percent.

The amount of titanium present in the alloys of this invention, if any, may vary from about 0.05 to about 2 weight percent, more preferably from 0.1 to about 1 weight percent, and even more preferably from about 0.1 to about 0.5 weight percent.

The amount of hafnium present in the alloys of this invention, if any, may vary from about 0.05 to about 2 weight percent, more preferably from about 0.1 to about 1 weight percent, and even more preferably from about 0.1 to about 0.5 weight percent.

The amount of niobium present in the alloys of this invention, if any, may vary from about 0.05 to about 1 weight percent, more preferably from about 0.1 to about 0.75 weight percent, and even more preferably from about 0.1 to about 0.5 weight percent.

In order to have the best properties for the alloys of this invention, it is desirable to limit the amount of other elements. Specific elements that should be reduced or eliminated include no more than about 0.1 weight percent iron, about 0.1 weight percent chromium, about 0.1 weight percent manganese, about 0.1 weight percent vanadium, about 0.1 weight percent cobalt, and about 0.1 weight percent nickel. The total quantity of additional elements should not exceed about 1% by weight, including the above listed impurities and other elements.

Other additions in the alloys of this invention include at least one of about 0.001 weight percent to about 0.10 weight percent sodium, about 0.001 weight percent to about 0.10 weight calcium, about 0.001 weight percent to about 0.10 weight percent strontium, about 0.001 weight percent to about 0.10 weight percent antimony, about 0.001 weight percent to about 0.10 weight percent barium and about 0.001 weight percent to about 0.10 weight percent phosphorus. These are added to refine the microstructure of the eutectic phase and the primary magnesium or lithium morphology and size.

These aluminum alloys may be made by any and all consolidation and fabrication processes known to those in the art such as casting (without further deformation), deformation processing (wrought processing), rapid solidification processing, forging, extrusion, rolling, die forging, powder metallurgy and others. The rapid solidification process should have a cooling rate greater that about $10^{3}$° C./second including but not limited to powder processing, atomization, melt spinning, splat quenching, spray deposition, cold spray, plasma spray, laser melting and deposition, ball milling and cryomilling.

Additional exemplary aluminum alloys of this invention include, but are not limited to (in weight percent):

about Al-(2-7)Cu-(0.4-3)Mg-(1-2.5)Li-(0.1-0.35)Sc-(0.2-2.0)Gd;

about Al-(2-7)Cu-(0.4-3)Mg-(1-2.5)Li-(0.1-4)Er-(0.2-2.0)Gd;

about Al-(2-7)Cu-(0.4-3)Mg-(1-2.5)Li-(0.2-6)Tm-(0.2-2.0)Gd;

about Al-(2-7)Cu-(0.4-3)Mg-(1-2.5)Li-(0.2-8)Yb-(0.2-2.0)Gd;

about Al-(2-7)Cu-(0.4-3)Mg-(1-2.5)Li-(0.2-8)Lu-(0.2-2.0)Gd;

about Al-(2-7)Cu-(0.4-3)Mg-(1-2.5)Li-(0.1-0.35)Sc-(0.2-2.0)Y;

about Al-(2-7)Cu-(0.4-3)Mg-(1-2.5)Li-(0.1-4)Er-(0.2-2.0)Y;

about Al-(2-7)Cu-(0.4-3)Mg-(1-2.5)Li-(0.2-6)Tm-(0.2-2.0)Y;

about Al-(2-7)Cu-(0.4-3)Mg-(1-2.5)Li-(0.2-8)Yb-(0.2-2.0)Y;

about Al-(2-7)Cu-(0.4-3)Mg-(1-2.5)Li-(0.2-8)Lu-(0.2-2.0)Y;

about Al-(2-7)Cu-(0.4-3)Mg-(1-2.5)Li-(0.1-0.35)Sc-(0.1-0.75)Zr;

about Al-(2-7)Cu-(0.4-3)Mg-(1-2.5)Li-(0.1-4)Er-(0.1-0.75)Zr;

about Al-(2-7)Cu-(0.4-3)Mg-(1-2.5)Li-(0.2-6)Tm-(0.1-0.75)Zr;

about Al-(2-7)Cu-(0.4-3)Mg-(1-2.5)Li-(0.2-8)Yb-(0.1-0.75)Zr;

about Al-(2-7)Cu-(0.4-3)Mg-(1-2.5)Li-(0.2-8)Lu-(0.1-0.75)Zr;

about Al-(2-7)Cu-(0.4-3)Mg-(1-2.5)Li-(0.1-0.35)Sc-(0.1-1.0)Ti;

about Al-(2-7)Cu-(0.4-3)Mg-(1-2.5)Li-(0.1-0.5)Er-(0.1-1.0)Ti;

about Al-(2-7)Cu-(0.4-3)Mg-(1-2.5)Li-(0.2-6)Tm-(0.1-1.0)Ti;

about Al-(2-7)Cu-(0.4-3)Mg-(1-2.5)Li-(0.2-8)Yb-(0.1-1.0)Ti;

about Al-(2-7)Cu-(0.4-3)Mg-(1-2.5)Li-(0.1-4)-Lu-(0.1-1.0)Ti;

about Al-(2-7)Cu-(0.4-3)Mg-(1-2.5)Li-(0.1-0.35)Sc-(0.1-1.0)Hf;

about Al-(2-7)Cu-(0.4-3)Mg-(1-2.5)Li-(0.1-4)Er-(0.1-1.0)Hf;

about Al-(2-7)Cu-(0.4-3)Mg-(1-2.5)Li-(0.2-6)Tm-(0.1-1.0)Hf;

about Al-(2-7)Cu-(0.4-3)Mg-(1-2.5)Li-(0.2-8)Yb-(0.1-1.0)Hf;

about Al-(2-7)Cu-(0.4-3)Mg-(1-2.5)Li-(0.2-8)Lu-(0.1-1.0)Hf;

about Al-(2-7)Cu-(0.4-3)Mg-(1-2.5)Li-(0.1-0.35)Sc-(0.1-0.75)Nb;

about Al-(2-7)Cu-(0.4-3)Mg-(1-2.5)Li-(0.1-4)Er-(0.1-0.75)Nb;

about Al-(2-7)Cu-(0.4-3)Mg-(1-2.5)Li-(0.2-6)Tm-(0.1-0.75)Nb;

about Al-(2-7)Cu-(0.4-3)Mg-(1-2.5)Li-(0.2-8)Yb-(0.1-0.75)Nb; and about Al-(2-7)Cu-(0.4-3)Mg-(1-2.5)Li-(0.2-8)Lu-(0.1-0.75)Nb.

Preferred examples of similar alloys to these are alloys with about 3.5 to about 6.5 weight percent copper, alloys with about 0.5 to about 2.0 weight percent magnesium, and alloys with about 1.0 to about 2.0 weight percent lithium.

Even more preferred exemplary aluminum alloys of this invention include, but are not limited to (in weight percent):

about Al-(3.5-6.5)Cu-(0.5-2)Mg-(1-2)Li-(0.1-0.25)Sc-(0.2-2.0)Gd;

about Al-(3.5-6.5)Cu-(0.5-2)Mg-(1-2)Li-(0.2-2)Er-(0.2-2.0)Gd;

about Al-(3.5-6.5)Cu-(0.5-2)Mg-(1-2)Li-(0.2-4)Tm-(0.2-2.0)Gd;

about Al-(3.5-6.5)Cu-(0.5-2)Mg-(1-2)Li-(0.2-4)Yb-(0.2-2.0)Gd;

about Al-(3.5-6.5)Cu-(0.5-2)Mg-(1-2)Li-(0.2-4)Lu-(0.2-2.0)Gd;

about Al-(3.5-6.5)Cu-(0.5-2)Mg-(1-2)Li-(0.1-0.25)Sc-(0.5-2.0)Y;

about Al-(3.5-6.5)Cu-(0.5-2)Mg-(1-2)Li-(0.2-2)Er-(0.5-2.0)Y;

about Al-(3.5-6.5)Cu-(0.5-2)Mg-(1-2)Li-(0.2-4)Tm-(0.5-2.0)Y;

about Al-(3.5-6.5)Cu-(0.5-2)Mg-(1-2)Li-(0.2-4)Yb-(0.5-2.0)Y;

about Al-(3.5-6.5)Cu-(0.5-2)Mg-(1-2)Li-(0.2-4)Lu-(0.5-2.0)Y;

about Al-(3.5-6.5)Cu-(0.5-2)Mg-(1-2)Li-(0.1-0.25)Sc-(0.1-0.5)Zr;

about Al-(3.5-6.5)Cu-(0.5-2)Mg-(1-2)Li-(0.2-2)Er-(0.1-0.5)Zr;

about Al-(3.5-6.5)Cu-(0.5-2)Mg-(1-2)Li-(0.2-4)Tm-(0.1-0.5)Zr;

about Al-(3.5-6.5)Cu-(0.5-2)Mg-(1-2)Li-(0.2-4)Yb-(0.1-0.5)Zr;

about Al-(3.5-6.5)Cu-(0.5-2)Mg-(1-2)Li-(0.2-4)Lu-(0.1-0.5)Zr;

about Al-(3.5-6.5)Cu-(0.5-2)Mg-(1-2)Li-(0.1-0.25)Sc-(0.1-0.5)Ti;

about Al-(3.5-6.5)Cu-(0.5-2)Mg-(1-2)Li-(0.1-0.5)Er-(0.1-0.5)Ti;

about Al-(3.5-6.5)Cu-(0.5-2)Mg-(1-2)Li-(0.2-4)Tm-(0.1-0.5)Ti;

about Al-(3.5-6.5)Cu-(0.5-2)Mg-(1-2)Li-(0.2-4)Yb-(0.1-0.5)Ti;

about Al-(3.5-6.5)Cu-(0.5-2)Mg-(1-2)Li-(0.1-4)-Lu-(0.1-0.5)Ti;

about Al-(3.5-6.5)Cu-(0.5-2)Mg-(1-2)Li-(0.1-0.25)Sc-(0.1-0.5)Hf;

about Al-(3.5-6.5)Cu-(0.5-2)Mg-(1-2)Li-(0.2-2)Er-(0.1-0.5)Hf;

about Al-(3.5-6.5)Cu-(0.5-2)Mg-(1-2)Li-(0.2-4)Tm-(0.1-0.5)Hf;

about Al-(3.5-6.5)Cu-(0.5-2)Mg-(1-2)Li-(0.2-4)Yb-(0.1-0.5)Hf;

about Al-(3.5-6.5)Cu-(0.5-2)Mg-(1-2)Li-(0.2-4)Lu-(0.1-0.5)Hf;

about Al-(3.5-6.5)Cu-(0.5-2)Mg-(1-2)Li-(0.1-0.25)Sc-(0.1-0.5)Nb;

about Al-(3.5-6.5)Cu-(0.5-2)Mg-(1-2)Li-(0.2-2)Er-(0.1-0.5)Nb;

about Al-(3.5-6.5)Cu-(0.5-2)Mg-(1-2)Li-(0.2-4)Tm-(0.1-0.5)Nb;

about Al-(3.5-6.5)Cu-(0.5-2)Mg-(1-2)Li-(0.2-4)Yb-(0.1-0.5)Nb; and about Al-(3.5-6.5)Cu-(0.5-2)Mg-(1-2)Li-(0.2-4)Lu-(0.1-0.5)Nb.

Although the present invention has been described with reference to preferred embodiments, workers skilled in the art will recognize that changes may be made in form and detail without departing from the spirit and scope of the invention.

The invention claimed is:

1. A heat treatable aluminum alloy consisting of:

about 1.0 to about 8.0 weight percent copper;

about 2.0 to about 4.0 weight percent magnesium;

about 0.5 to about 3.0 weight percent lithium;

at least one first element selected from the group consisting of about 0.1 to about 0.5 weight percent scandium; about 0.1 to about 6.0 weight percent erbium, about 0.1 to about 10.0 weight percent thulium, about 0.1 to about 15.0 weight percent ytterbium, and about 0.1 to about 12.0 weight percent lutetium;

at least one second element selected from the group consisting of about 0.1 to about 4.0 weight percent gadolinium, about 0.1 to about 4.0 weight percent yttrium, about 0.05 to about 1.0 weight percent zirconium, about 0.05 to about 2.0 weight percent titanium, about 0.05 to about 2.0 weight percent hafnium, and about 0.05 to about 1.0 weight percent niobium;

at least one of about 0.001 weight percent to about 0.1 weight percent sodium, about 0.001 weight percent to about 0.1 weight calcium, about 0.001 weight percent to about 0.1 weight percent strontium, about 0.001 weight percent to about 0.1 weight percent antimony, about 0.001 weight percent to about 0.1 weight percent barium and about 0.001 weight percent to about 0.1 weight percent phosphorus;

no more than about 0.1 weight percent iron, about 0.1 weight percent chromium, about 0.1 weight percent manganese, about 0.1 weight percent vanadium, about 0.1 weight percent cobalt, and about 0.1 weight percent nickel;

no more than about 1.0 weight percent total other additional elements not listed therein including impurities;

and the balance substantially aluminum;

wherein the alloy is formed by rapid solidification processing at a cooling rate greater than about $10^{3}$° C./second, followed by heat treating by a solution anneal at a temperature of about 800° F. (426° C.) to about 1100° F. (593° C.) for about 30 minutes to four hours, followed by quenching, and is thereafter aged at a temperature of about 200° F. (93° C.) to about 600° F. (316° C.) for about two to forty-eight hours.

2. The alloy of claim 1, wherein the alloy has an aluminum solid solution matrix containing a plurality of dispersed $Al_3X$ second phases having $L1_2$ structures, wherein X includes the at least one first element and the at least one second element.

3. The heat treatable aluminum alloy of claim 1, wherein the alloy is capable of being used at temperatures from about −420° F. (−251° C.) up to about 650° F. (343° C.).

4. A heat treatable aluminum alloy consisting of:

about 1.0 to about 8.0 weight percent copper;

about 2.0 to about 4.0 weight percent magnesium;

about 0.5 to about 3.0 weight percent lithium;

an aluminum solid solution matrix containing a plurality of dispersed $Al_3X$ second phases having $L1_2$ structures where X includes at least one first element selected from the group consisting of about 0.1 to about 0.5 weight percent scandium; about 0.1 to about 6.0 weight percent erbium, about 0.1 to about 10.0 weight percent thulium, about 0.1 to about 15.0 weight percent ytterbium, and about 0.1 to about 12.0 weight percent lutetium, about 0.1 to about 4.0 weight percent gadolinium, about 0.1 to about 4.0 weight percent yttrium, about 0.05 to about 1.0 weight percent zirconium, about 0.05 to about 2.0 weight percent titanium, about 0.05 to about 2.0 weight percent hafnium, and about 0.05 to about 1.0 weight percent niobium; and no more than about 1.0 weight percent total other additional elements not listed therein including impurities;

the balance substantially aluminum;

wherein the alloy is formed by rapid solidification processing at a cooling rate greater than about $10^{3}$° C./second, followed by heat treating by a solution anneal at a temperature of about 800° F. (426° C.) to about 1100° F. (593° C.) for about 30 minutes to four hours, followed by quenching, and is thereafter aged at a temperature of about 200° F. (93° C.) to about 600° F. (316° C.) for about two to forty-eight hours.

* * * * *

UNITED STATES PATENT AND TRADEMARK OFFICE

CERTIFICATE OF CORRECTION

PATENT NO. : 7,875,133 B2
APPLICATION NO. : 12/148396
DATED : January 25, 2011
INVENTOR(S) : Awadh B. Pandey It is certified that error appears in the above-identified patent and that said Letters Patent is hereby corrected as shown below:

Col. 12, Line 8

Insert --percent-- between “weight” and “calcium”

Signed and Sealed this
Nineteenth Day of April, 2011

David J. Kappos

David J. Kappos
*Director of the United States Patent and Trademark Office*